US006470839B2

(12) United States Patent
Chang

(10) Patent No.: US 6,470,839 B2
(45) Date of Patent: Oct. 29, 2002

(54) ENGINE BLOCK HAVING IMPROVED COOLING SYSTEM

(75) Inventor: Byung-Hak Chang, Kunpo (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/848,258

(22) Filed: May 4, 2001

(65) Prior Publication Data

US 2002/0026908 A1 Mar. 7, 2002

(30) Foreign Application Priority Data

Sep. 4, 2000 (KR) ..... 2000-52006

(51) Int. Cl.[7] ..... F02F 1/14
(52) U.S. Cl. ..... 123/41.79; 123/41.72
(58) Field of Search ..... 123/41.72, 41.74, 123/41.79

*Primary Examiner*—Noah P. Kamen
(74) *Attorney, Agent, or Firm*—Birch, Stewart, Kolasch & Birch, LLP

(57) ABSTRACT

An engine block having a cooling system includes a body, a plurality of cylinder bores formed on the body, cylinder liners each coaxially fitted in a corresponding cylinder bore, and at least one coolant channel formed between the cylinder bores, wherein each cylinder liner has recesses on an outer surface facing other cylinder bores for securing space for forming the coolant channels.

6 Claims, 1 Drawing Sheet

ENGINE BLOCK HAVING IMPROVED COOLING SYSTEM

BACKGROUND OF THE INVENTION (a) Field of the Invention

The present invention relates to an engine block adopting an improved cooling system capable of efficiently cooling the cylinder block so as to improve engine performance.

(b) Description of the Related Art

An engine block of an automobile engine is a casting with appropriate machined surfaces and threaded holes for attaching a cylinder head, main bearings, oil pan, and other units.

Cylinders are openings of circular cross section that extend through to the upper portion of the block with interior walls bored and polished to form smooth, accurate surfaces. The cylinders of heavy-duty engines are usually fitted with removable liners made of metal that is more wear-resistant than the block casting material.

To carry away excessive heat, an engine is provided with a series of channels cast into the engine block and cylinder head, surrounding combustion chambers with circulating water or other coolant.

The channels are formed, particularly between the cylinders, using drilling or saw-cutting methods as well as through a casting process. Using drilling or saw-cutting methods requires 7 mm of inter-cylinder distance, and using casting methods, 12 mm are needed.

Recently, the inter-cylinder distance has tended to become shorter so as to comply with minimizing engine size, and furthermore, aluminum cylinder blocks have extremely small inter-cylinder distances of 3 mm, which cause difficulty in forming coolant channels between the cylinders.

SUMMARY OF THE INVENTION

The present invention has been made in an effort to solve the above problems of the prior art.

It is an object of the present invention to provide an engine block having coolant channels between cylinders with narrow inter-cylinder distance for efficiently cooling the engine block.

To achieve the above object, an engine block having a cooling system according to a preferred embodiment of the present invention comprises a body, a plurality of cylinder bores formed on the body, cylinder liners each coaxially fitted in a corresponding cylinder bore, and at least one coolant channel formed between the cylinder bores, wherein each cylinder liner has recesses on an outer surface facing other cylinder bores for securing space for forming the coolant channels.

BRIEF DESCRIPTION OF THE DRAWINGS

The accompanying drawings, which are incorporated in and constitute a part of the specification, illustrate an embodiment of the invention, and together with the description, serve to explain the principles of the invention.

DETAILED DESCRIPTION OF THE PREFERRED EMBODIMENTS

A preferred embodiment of the present invention will be described hereinafter with reference to the accompanying drawings.

Figure 1:
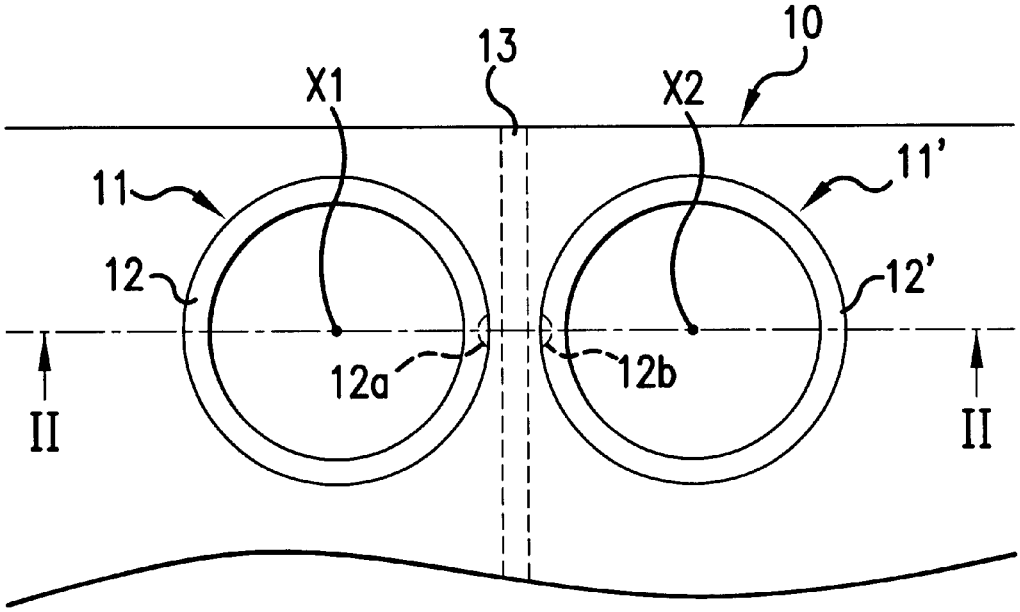
FIG. 1 is a schematic top plan view of an engine block having a cooling system according to a preferred embodiment of the present invention.
Figure 2:
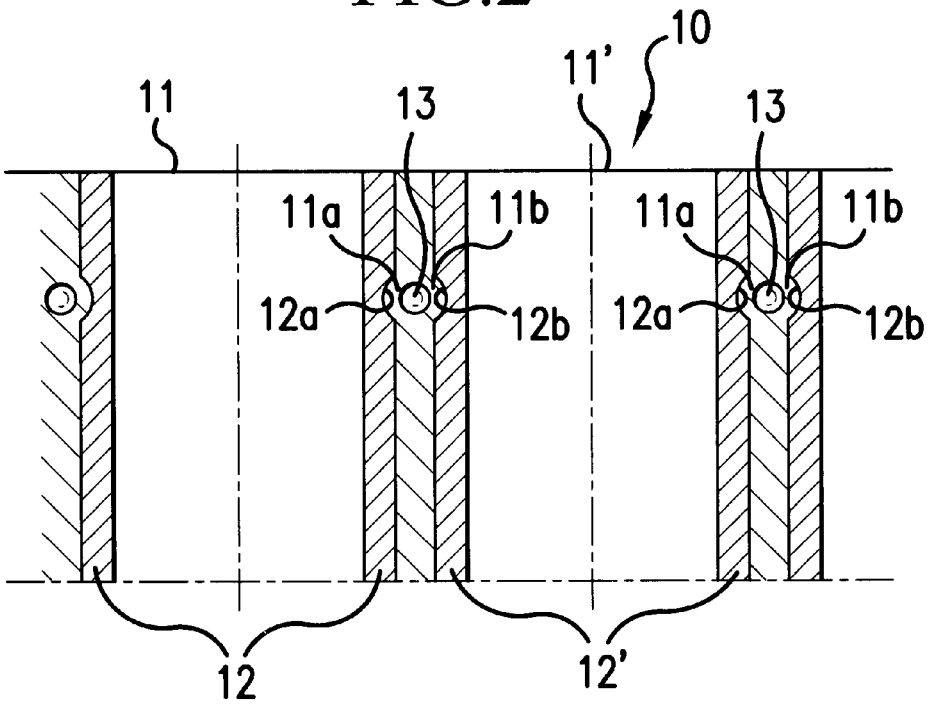
FIG. 2 is a sectional view taken along the line II—II of FIG. 1.

FIG. 1 is a schematic top plan view of an engine block having a cooling system according to a preferred embodiment of the present invention and FIG. 2 is a sectional view cut along the line II—II of FIG. 1.

As shown in FIG. 1, the cylinder block of the present invention comprises a body 10 defining a plurality of cylinder bores 11 and 11' in which cylinder liners 12 and 12' are coaxially fitted.

Each cylinder liner 12 (12') is provided with at least one recess 12*a* (12*b*) on its outer surface and each cylinder bore has a projected portion 11*a* (11*b*) on its inner wall such that the projected portions 11*a* and 11*b* fit within the respective recesses 12*a* and 12*b*. As a result, an area defined on a portion of the body 11 between the adjacent recesses 12*a* and 12*b* of the cylinder liners 12 and 12' is increased by the projected portions 11*a* and 11*b*.

Preferably, the recesses 12*a* and 12*b* are formed on the closest outer surfaces of the adjacent cylinder liners 12 and 12' at the same level. That is, as shown in FIG. 1, it is preferable that the centers of the recesses lie on an imaginary line interconnecting axes X1 and X2 of the adjacent cylinder bores 11 and 11'.

Accordingly, it is possible to form at least one coolant channel 13 at the increased portion of the body defined between the closest outer surfaces of the adjacent cylinder liners 12 and 12' in a perpendicular direction relative to axes of the cylinder bores 11 and 11'. The coolant channel 13 is simply formed by a drilling process.

Also the cylinder block 10 is manufactured using a die casting method, i.e., the body 10 is formed by casting molten metal around the previously manufactured and arranged cylinder liners 12 and 12'.

As described above, the engine block of the present invention is manufactured in such a way that the cylinder block provides enough space for forming at least one coolant channel between narrowly formed cylinder bores by forming recesses on the outer surfaces of the liners facing each other.

As a result, it is possible to minimize the size of the engine block by making distances between the cylinder bores narrower with coolant channels without degrading engine performance.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims. For example, in the above described embodiment, although the recess is formed on all of the closest outer surfaces of the adjacent cylinder liners, it is also possible to form the recess on only one of the closes outer surfaces of the adjacent cylinder liners as far as the area for forming the collant channel can be sufficiently provided.

What is claimed is:

1. An engine block having a cooling system comprising:

a body;

a plurality of cylinder bores formed on the body;

a plurality of cylinder liners coaxially fitted in the cylinder bores, respectively; and at least one coolant channel formed between the cylinder bores, wherein at least one of the cylinder liners has a recess in which a projected portion formed on a wall defining the cylinder bore is fitted, thereby providing a a sufficient space for forming the coolant channels on the body.

2. An engine block of claim 1 wherein the coolant channel is formed through a drilling process.

3. An engine block of claim 1 wherein the cylinder block is formed by casting molten metal around the cylinder liners.

4. An engine block of claim 1 wherein the recess is formed on one of the closest outer surfaces of the adjacent cylinder liners.

5. An engine block of claim 1 whrein the recesses are formed on the closest outer surfaces at the same level.

6. An engine block of claim 1 wherein a center of the recess lies on an imaginary line interconnecting the axes of the adjacent cylinder bores.

* * * * *